US007685962B1

(12) United States Patent
Hall

(10) Patent No.: US 7,685,962 B1
(45) Date of Patent: Mar. 30, 2010

(54) FALLEN GAME LOCATOR

(76) Inventor: Van Lloyd Hall, 7663 S. 2450 West, West Jordan, UT (US) 84084

( * ) Notice: Subject to any disclaimer, the term of this patent is extended or adjusted under 35 U.S.C. 154(b) by 54 days.

(21) Appl. No.: 12/218,647

(22) Filed: Jul. 16, 2008

Related U.S. Application Data

(60) Provisional application No. 60/961,128, filed on Jul. 18, 2007.

(51) Int. Cl.
*G01D 21/00* (2006.01)
*G01C 15/02* (2006.01)

(52) U.S. Cl. ..... 116/209; 116/201; 33/277; 33/293

(58) Field of Classification Search ..... 116/200, 116/201, 209, 175, DIG. 15; 33/227, 228, 33/265, 274, 276, 277, 293, 297, 506; 124/87; D10/109, 121
See application file for complete search history.

(56) References Cited

U.S. PATENT DOCUMENTS 2,767,472 A * 10/1956 Kocur ..... 33/265
3,102,359 A * 9/1963 Cahill et al. ..... 43/43.14
4,616,421 A * 10/1986 Forsen ..... 42/130
5,146,687 A * 9/1992 Kjellstrom ..... 33/355 R
6,299,379 B1 * 10/2001 Lewis ..... 404/9
7,301,469 B1 * 11/2007 Hoffman et al. ..... 340/815.54
7,543,389 B2 * 6/2009 Grace, Jr. ..... 33/265
2008/0184609 A1 * 8/2008 Schulst ..... 42/111

* cited by examiner

*Primary Examiner*—Amy Cohen Johnson

(57) ABSTRACT

A fallen game locator to aid the hunter in locating the precise location game was when shot. A cylindrical, cone shaped device with unspecified fluorescent or brightly colored series of rings on the exterior, working in conjunction with a target site viewer tube, extending through the small center tip of the cone shaped device, through and beyond the larger opening of the cone shaped device with the back plate in place, and secured to a riser so as to enable the series of colored rings to be seen from multiple locations, at a distance, with the naked eye, a scope, or binoculars, thus economizing the length of time required to find shot game.

1 Claim, 5 Drawing Sheets

Exploded View of Essential Elements

| NAME | ELEMENT # |
|---|---|
| SIGHT CONE | 10 |
| SIGHTING TUBE | 11 |
| BACK PLATE | 12 |
| COLOR A | 13 |
| COLOR B | 14 |
| COLOR C | 15 |
| COLOR D | 16 |
| COLOR E | 17 |

Side and Front View

| NAME | ELEMENT # |
|---|---|
| SIGHTING TUBE | 11 |

Back Plate Detail

Sight Cone Side Detail

| NAME | ELEMENT # |
|---|---|
| SIGHT CONE | 10 |

| ELEMENT # | COLOR REFERENCE |
|---|---|
| 13 | A |
| 14 | B |
| 15 | C |
| 16 | D |
| 17 | E |

| NAME | ELEMENT # |
|---|---|
| SIGHT CONE | 10 |
| COLOR A | 13 |
| COLOR B | 14 |
| COLOR C | 15 |
| COLOR D | 16 |
| COLOR E | 17 |

FALLEN GAME LOCATOR

CROSS-REFERENCE TO RELATED APPLICATIONS

This application is based on Provisional Application Ser. No. 60/961,128, filed Jul. 18, 2007 to Van Lloyd hall, the disclosure of which is incorporated herein by reference and to which priority is claimed.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

FIELD OF THE INVENTION

The present invention relates to allowing a game hunter to find a downed game, or, at least, the blood trail, and, more particularly, to do so with accuracy, reducing the time searching for downed game.

BACKGROUND OF THE INVENTION

The hunting party has made all of the necessary preparations and plans. Camping, food, change of clothes, ammunition. You rise early, well before the sun. You eat breakfast while going over the logistics . . . who will drive the deer (elk, moose, boar, etc. . . . ) to you who will be sitting on the ridge, waiting to take the shot. With breakfast and plans in place, you leave to carry out this carefully laid plan for the hunt. Everything is going well. You climb to your spotting post and wait. Finally, your target is there. You raise your rifle (or bow), take aim, squeeze off a shot and watch your game falter. This is where the real hunt begins and time is of the essence. You must find the deer, make sure that there is no suffering and save the meat.

You leave your shooting post, climb down the hill and go right to the spot you are sure the game was standing when you shot it. You made notes about what to look for. The tall lodge pole pine. The three Aspens on the right of the big rock. You are sure this is the spot. You search and search for a blood tail, any sign. The rest of the hunting party finds you and join in the search. You all spread out. After many crucial hours searching, you have to call it a night. The hunting party returns to camp, worries about the animal being in pain, and all get a restless nights sleep, only to rise in the morning and head back out to search again.

The plan is, you will go back to the ridge where you shot from and guide the rest of the hunting party in the search. After another day of hunting, someone finally finds the blood trail. You follow this trail, which leads you several hundred yards to the fallen deer, a healthy four (4) point. Its been a warm Autumn. After this many hours dead, in the sun, the meat is already rotten. The animal is wasted because it took so long to locate, and signs there show a great deal of suffering before the animal finally died.

OR;

It snows. HARD. All night. You call off the search because there is too much snow to be hiking around looking for a fallen animal.

OR;

You are so excited to have finally been able to shoot at anything, you take off down the hill before remembering to find your identifying markers and you realized that you have no idea where to begin looking.

A search on the internet will take you to any number of articles on just how to track your game, once shot. The suggestions are widely subjective, and center on being able to identify the exact spot your game was standing when it was shot. In many situations, there is simply a lack of distinct identifying markers.

BRIEF SUMMARY OF THE INVENTION

In accordance with the present invention, there is provided a Fallen Game Locator to aid the hunter in locating the precise location that game was when shot. A cylindrical cone shaped device with fluorescent or brightly colored rings on the outside, a target sighting viewer tube through the center of the cone shaped device and the back plate, and, secured to a riser so as to enable being seen from multiple locations at a distance with the naked eye, a scope or binoculars.

An accessory for the hunter, which is light weight, virtually unnoticeable to pack or transport, simple to use and understand, and yet, extremely precise in pointing and guiding the hunter to the exact location game was when shot. By correctly pointing this device to the exact location game was when shot, and then simply following the markers or rings on the exterior of the apparatus as stated in the directions for use, will lead the hunter to the site where game was when shot, thus, enabling the hunter to retrieve the meat expeditiously and reduce spoilage of shot game due to inability to locate game after it has been shot. If made of biodegradable material, minute to no detectable environmental impact occurs with the use of this device.

It is therefore an object of the invention to be pointed or aimed directly to the site where game was when it was shot.

It is another object of the invention, through the application of exterior markers or rings, to direct the hunter directly to the site where game was when it was shot, according to the appearance of the markers or rings from any given view.

It is another object of the invention to reduce the time and effort in finding the site where game was when shot.

It is another object of the invention to assist the hunter in the prompt location of shot game, enabling a quick end to the suffering of the shot animal and the safe retrieval of the meat.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

Throughout this Non-provisional patent application, the number of rings and the colors stated are suggestive in nature and used herein for suggested and visual purposes and in no way depict, or limit any set number of markers or rings nor any set measurement of any part of the subject of the invention, or, any set use of colors as the exterior markers or rings.

DETAILED DESCRIPTION OF THE INVENTION

Figure 1:
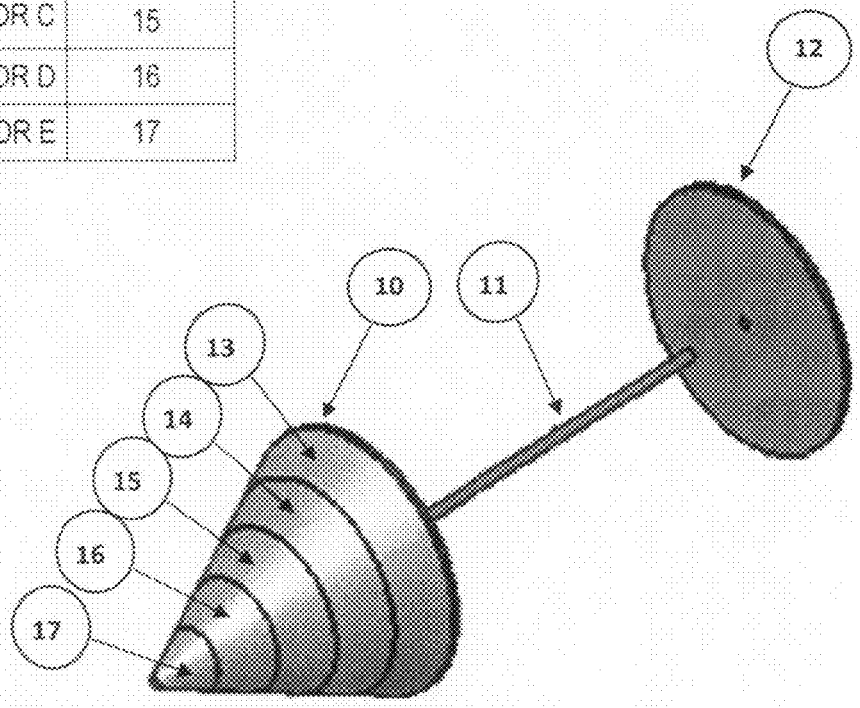
FIG. 1 is an exploded view of a fallen game locator.

FIG. 1 is an exploded view of all essential elements of the fallen game locator. This consists of the sight cone 10 encircled with one (1) section each, of five (5) chosen fluorescent or very bright colors; color A 13, color B 14, color C 15, color D 16, and color E 17, as well as the sighting viewer tube 11 and the back plate 12.

The sight cone 10 should be of ample size in length and diameter to be seen from a distance with the naked eye, a scope, or binoculars. The sight cone 10 is placed or fastened on a riser or surface that will allow it to be seen from a distance with the naked eye, a scope, or binoculars. The sight cone 10 is divided evenly five (5) times, stated only to provide a visual reference and not to limit the invention in any way, from the front tip to the rear opening with colored rings. Each of the five (5) colored rings; color A 13, color B 14, color C 15, color D 16 and color E 17, number of rings being used for example herein, is a different fluorescent or bright color that would be easily seen from a distance with the naked eye, a scope, or binoculars.

The sight cone 10 is capped off at the large opening with the back plate 12. The back plate 12 has a hole in the center, similar in size to the exterior diameter of the sighting viewer tube 11. The sighting viewer tube 11 is placed in and through the sight cone 10 from the front small tip to and through the back plate 12, being inserted in the hole in the exact center of the back plate 12.

Figure 2:
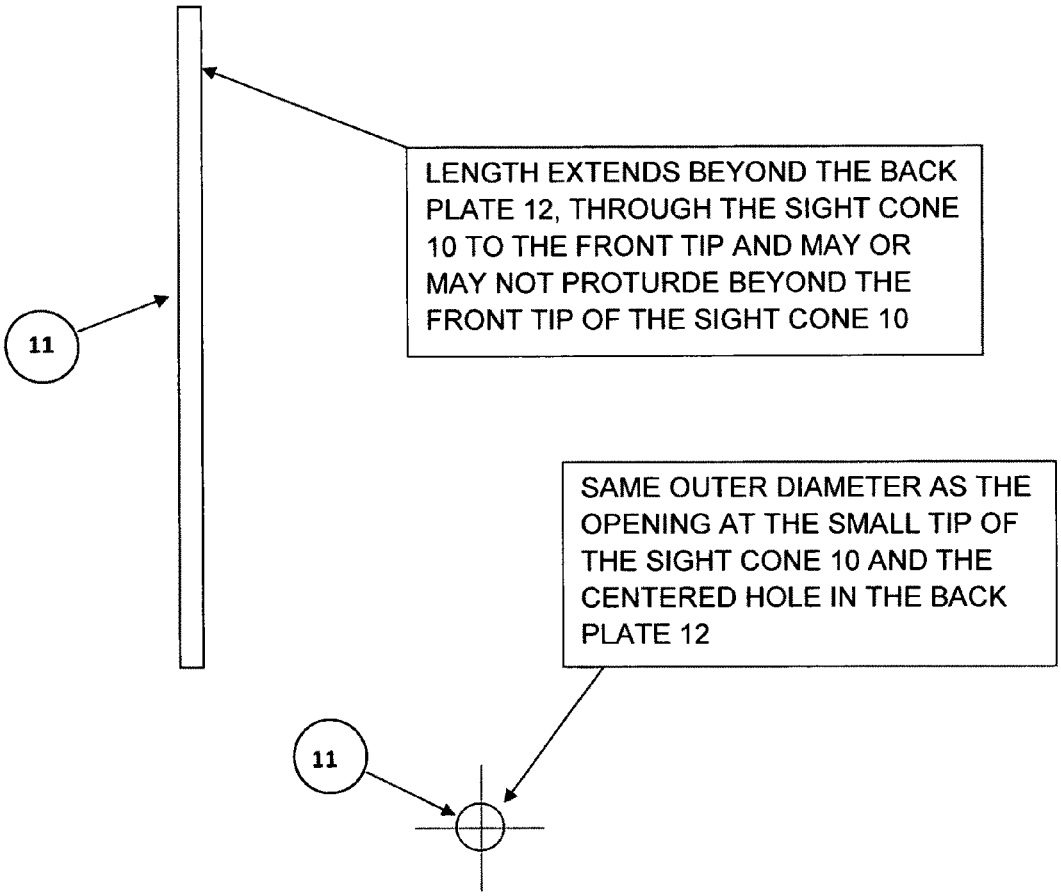
FIG. 2 is a side and front detail view of the sighting viewer tube of the fallen game locator.

FIG. 2 is a side and front view of a sighting viewer tube 11. The sighting viewer tube 11 is inserted in and through the sight cone 10, extending from beyond the back plate 12 to the front tip of the sight cone 10. The sighting viewer tube 11 is small in diameter, but large enough that a person with normal eyesight can look through it to a point a distance away. The exterior dimension of the sighting viewer tube 11 is similar in size to the opening in the back plate 12 and the front tip of the sight cone 10.

Figure 3:
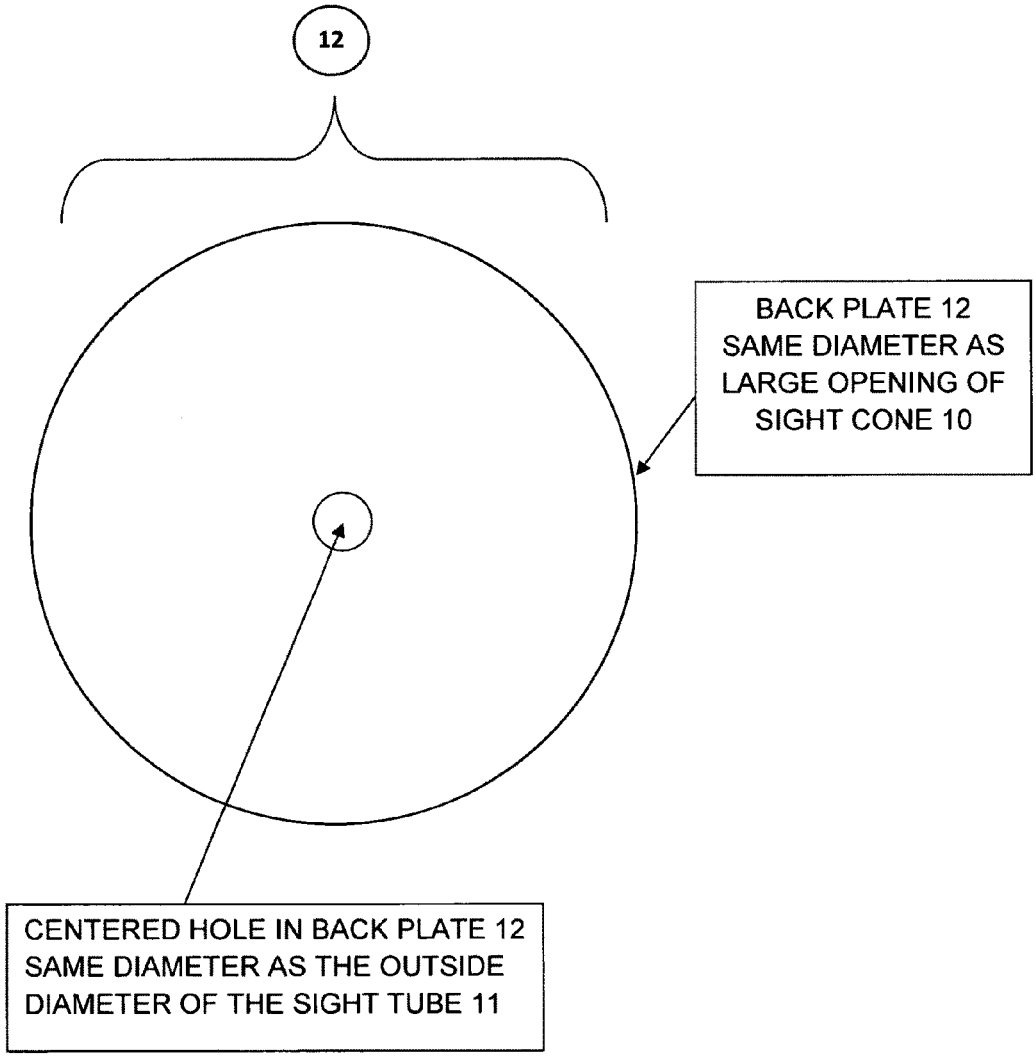
FIG. 3 is a rear view of the back plate, showing placement of sighting viewer tube in the center of the back plate which is affixed at or in the large opening of the cone shaped object of the fallen game locator.

FIG. 3 is a back plate 12 detail of a fallen game locator showing placement of sighting viewer tube 11 in the center of the back plate 12. The exterior dimension of the back plate 12 is slightly less than the interior dimension of the sight cone 10. The hole in the center of the back plate 12 is similar in dimension as the exterior dimension of the sighting viewer tube 11.

Figure 4:
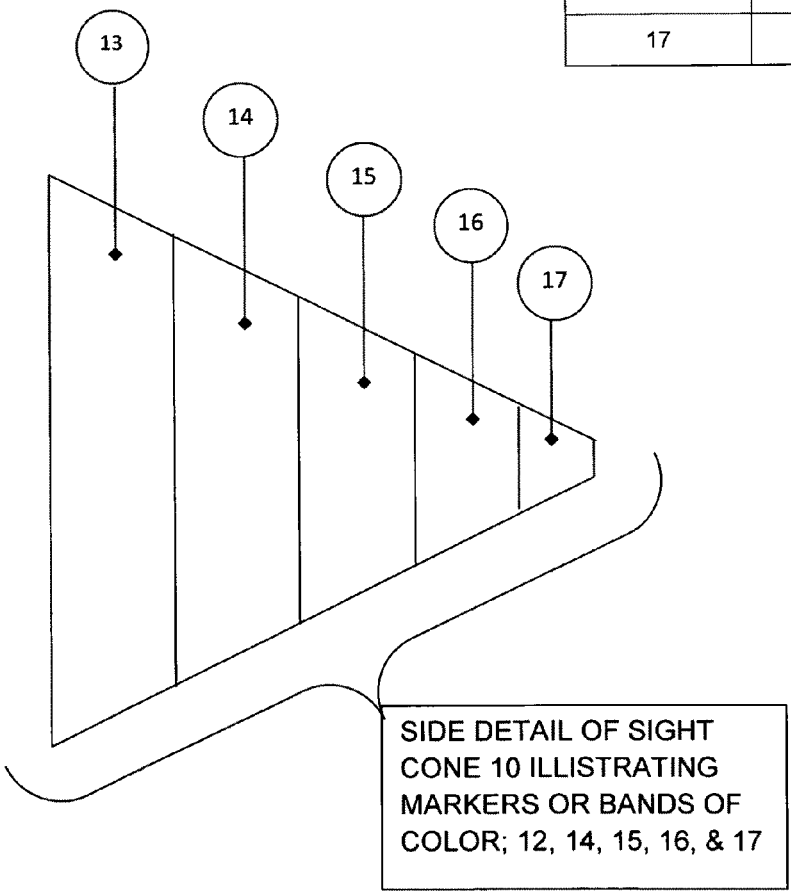
FIG. 4 is a side detail view of the fallen game locator, a cone shaped object, detailing different colored markers or rings, the number and/or color of rings not limited to depiction herein, encircling the exterior of the sight cone; and, FIG. 5 is a side and front view of a fallen game locator sight cone showing an example of detail relating to the colored rings or markers on the exterior of said cone.

FIG. 4 is a side detail view of five (5) colored rings, which number and color of rings and suggested only for purpose of reference in this application, encircling the exterior of the sight cone 10. Each of the colored rings; color A 13, color B 14, color C 15, color D 16, color E 17, being suggestive in number, color and measurement for description purposes only, is a different fluorescent or bright color that could easily be seen from a distance with the naked eye, a scope, or binoculars. Each of the colored ring; color A 13, color B 14, color C 15, color D 16 and color E 17, are one fifth the length (from the sight cone 10 tip to the sight cone 10 rear opening) of the sight cone 10, measurements and distribution are suggestive for visual purposes only. The chosen illustration is the description of five (5) colored rings and is strictly for the purpose of describing the function of the colored rings in guiding the hunter to the site where game was standing when shot. This does not, in any way, limit or dictate the number of colored rings on the sight cone 10.

Figure 5:
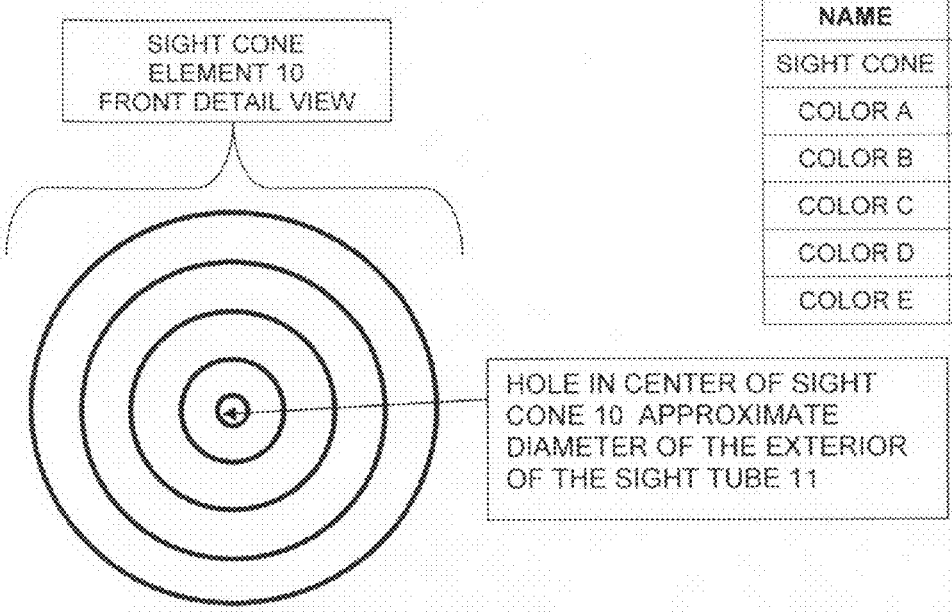
Figure 5:
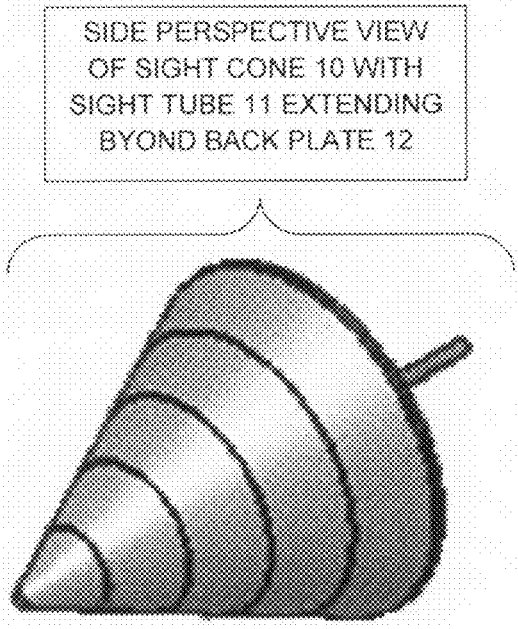

FIG. 5 is a side and front view of a fallen game locator sight cone 10.

The side view of the fallen game locator shows each of the chosen fluorescent or brightly colored bands or rings of colors; color A 13, color B 14, color C 15, color D 16 and color E 17, as one fifth of the sight cone 10 from the large rear opening to the smaller front tip, number of colors and measurements are stated for reference only and do not depict an exacting description.

The front view of the fallen game locator shows the hole for the sighting viewer tube 11 in the center and each of the colored bands of fluorescent or bright color; color A 13, color B 14, color C 15, color D 16, and color E 17, as one fifth of the length of the sight tube, colors and measurements stated only for reference and do not limit measurements or colors.

The function of the Fallen Game Locator is to direct the hunter to the exact site where game was when shot. This is accomplished by each of the listed elements in the Fallen Game Locator working in conjunction to point the hunter to the site where game was when shot. After shooting the game, the hunter places or fixes the Fallen Game Locator on to a riser. By looking through the sighting viewer tube 11 from the large opening back plate 12, the hunter can point the small tip of the Fallen Game Locator sight cone 10, by looking through the sighting viewer tube 11 from the back plate 12, directly at the site where game was when shot.

The sight cone 10, housing the sighting viewer tube 11, has bands or rings of color; color A 13, color B 14, color C 15, color D 16 and color E 17, number of colors being suggestive only. When the hunter looks through the sighting viewer tube 11 from the back plate 12 and points the Fallen Game Locator sight tube 10, to the site where game was when shot, the bands of color: color A 13, color B 14, color C 15, color D 16 and color E 17, number of listed colors are for reference only, act as a pointing device. When the hunter heads in the general direction where game was when shot, the bands of color; color A 13, color B 14, color C 15, color D 16 and color E 17, listed only as a reference, are visible. The hunter can tell which direction to walk or hike towards based upon how the bands of color appear.

Standing in the exact position that the sighting viewer tube 11 is sighted on, the bands of color; color A 13, color B 14, color C 15, color D 16 and color E 17, listed for reference only, encircling the sight cone 10 will appear as complete circles of each color; color A 13, color B 14, color C 15, color D 16 and color E 17, listed as reference only, in correct proportion to each other, with the look of a circular target. If the hunter is to the right or left of the site, or above or below the site, the hunter will not see a complete circle of each color, but will see a semi-circle of colors; color A 13, color B 14, color C 15, color D 16 and color E 17, listed as reference only, in a range of positions from a semi-circle pointing to the right, a semi-circle pointing up, or a semi-circle pointing to the left, or, a semi-circle pointing down. Depending on the direction of ends of the semi-circle, the hunter will know to travel in the direction the ends of the semi-circle of colors; color A 13, color B 14, color C 15, color D 16 and color E 17, listed as reference only, are pointing. As the hunter moves in that direction, the position of the ends of the semi-circle of colors, color A 13, color B 14, color C 15, color D 16 and color E 17, listed as reference only, will continue to change, continuing to point the hunter in the correct direction until the semi-circle of colors; color A 13, color B 14, color C 15, color D 16 and color E 17, listed as reference only, evolves into a complete circle of colors, being: color A 13, color B 14, color C 15, color D 16 and color E 17, listed only as reference. Ultimately, upon correct aim of the site cone and viewer tub at the site where game was when shot, the hunter would be able to see light through the sighting viewer tube 11 when standing at the exact site the sighting viewer tube 11 is pointed. At this point, the hunter may start to look for the blood trail, leading him directly to the downed animal, saving hours of searching.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A fallen game locator for aiding a game hunter in successful and expedited retrieval of a shot game animal by pinpointing a location of a game animal when shot, and leading or directing a hunter to a correct location a game animal occupied, comprising:

a cone shaped object having a small end and a large end, a central hole formed through the cone shaped object, the small end of the cone shaped object pointed to a direct site a game animal was when shot;

a tubular shaped object being hollow and having a diameter allowing a pinpoint view of a site where a game animal was when shot by observing a location where a game animal was shot through the tubular shaped object, the tubular shaped object centrally mounted in, to, and through the hole in the cone shaped object;

a back plate having a diameter which is smaller than a large end of the cone shaped object, the back plate having a central hole, the central hole having a diameter to accommodate the tubular shaped object so that the tubular shaped object, when mounted in the central hole, extends beyond the back plate; and, a plurality of differently colored rings located around and along a circumference of the cone shaped object, the plurality of differently colored rings being fluorescent or brightly colored thereby creating a target comprising differently colored rings from the small end of the cone shaped object changing colors in progression to the large end in the cone shaped object, the plurality of differently colored rings being visible from a distance.

* * * * *